US008182287B2

(12) United States Patent
Kondo

(10) Patent No.: US 8,182,287 B2
(45) Date of Patent: May 22, 2012

(54) SHIELD CASE, AND CONNECTOR HAVING THE SAME

(75) Inventor: Hayato Kondo, Yao (JP)

(73) Assignee: Hosiden Corporation, Yao-shi (JP)

( * ) Notice: Subject to any disclaimer, the term of this patent is extended or adjusted under 35 U.S.C. 154(b) by 0 days.

(21) Appl. No.: 12/896,248

(22) Filed: Oct. 1, 2010

(65) Prior Publication Data

US 2011/0097931 A1 Apr. 28, 2011

(30) Foreign Application Priority Data

Oct. 27, 2009 (JP) ..... 2009-246385

(51) Int. Cl.
*H01R 13/648* (2006.01)

(52) U.S. Cl. ..... 439/607.01

(58) Field of Classification Search ..... 439/607.01, 439/607.54, 579, 327
See application file for complete search history.

(56) References Cited

U.S. PATENT DOCUMENTS

| | | | | |
|---|---|---|---|---|
| 5,044,980 | A * | 9/1991 | Krumme et al. | 439/496 |
| 5,716,245 | A * | 2/1998 | Kameyama et al. | 439/852 |
| 5,800,204 | A | 9/1998 | Niitsu | 439/495 |
| 6,027,363 | A * | 2/2000 | Watt et al. | 439/456 |
| 6,036,520 | A * | 3/2000 | Tojo | 439/260 |
| 6,066,000 | A * | 5/2000 | Masumoto et al. | 439/607.34 |
| 6,416,359 | B1 | 7/2002 | Zhang et al. | 439/607 |
| 6,520,797 | B2 * | 2/2003 | Okamura et al. | 439/495 |
| 7,040,917 | B2 * | 5/2006 | Yagi et al. | 439/495 |
| 7,748,997 | B2 * | 7/2010 | Hamner et al. | 439/79 |
| 7,871,297 | B2 * | 1/2011 | Li | 439/607.54 |

FOREIGN PATENT DOCUMENTS

| | | |
|---|---|---|
| EP | 1 274 155 A1 | 1/2003 |
| JP | 2003-17165 A1 | 1/2003 |
| JP | 3109294 | 3/2005 |

OTHER PUBLICATIONS

European Search Report dated Feb. 9, 2011.

* cited by examiner

*Primary Examiner* — Jean F Duverne
(74) *Attorney, Agent, or Firm* — Kratz, Quintos & Hanson, LLP

(57) ABSTRACT

A shield case of the invention includes a receiving portion of generally rectangular tuboid shape adapted to accommodate a body with contacts arrayed, the receiving portion having a top plate and side walls; a folded-back portion, provided at a front end of the receiving portion and folded back rearward, or provided at a rear end of the receiving portion and folded back forward; and a cover of generally downward U-shape, extending from the folded-back portion and along the top plate and the side walls of the receiving portion.

12 Claims, 5 Drawing Sheets

SHIELD CASE, AND CONNECTOR HAVING THE SAME

The present application claims priority under 35 U.S.C. §119 of Japanese Patent Application No. 2009-246385 filed on Oct. 27, 2009, the disclosure of which is expressly incorporated by reference herein in its entity.

BACKGROUND OF THE INVENTION

1. Technical Field

The present invention relates to a shield case and a connector having the same.

2. Background Art

A conventional multipolar connector of this type is adapted for connection with two types of plug connectors as disclosed in Japanese Unexamined Patent Publication No. 2003-17165. The shield case of the multipolar connector has two connection ports formed to match outer shapes of the two types of plug connectors. As the two connection ports are provided alongside in the width direction of the shield case, the shield case should be long in width. Moreover, the connection ports are only sectioned by an elongated protrusion, which is either provided by folding upward the center of a bottom plate of the shield case or provided in the center of the bottom plate. In other words, the connection ports are not completely sectioned by the elongated protrusion, but they communicate with each other. As such, the shield case has insufficient strength in its top plate. If a plug connector inserted into one of the connection ports is twisted in the circumferential direction, the top plate of the shield case may warp. In short, the conventional multipolar connector is likely to suffer low prying resistance.

This problem may be solved in a second conventional connector having a first shield case and a second shield case contained in the first shield case, as disclosed in Japanese Utility Model Registration Publication No. 3109294. The first and second shield cases form a double-layer structure, so that sufficient prying resistance can be secured in the second connector even of wide shape as described above.

CITATION LIST

Patent Literature 1: Japanese Unexamined Patent Publication No. 2003-17165

Patent Literature 2: Japanese Utility Model Registration Publication No. 3109294

SUMMARY OF INVENTION

However, the second conventional connector has a different problem of laborious assembly in disposing the second shield case in the first shield case.

The present invention has been devised in light of the above-described situation. The present invention provides a shield case that is easy in fabrication and has an improved prying resistance. The invention also provides a connector including the shield case.

Solution to Problem

In view of the above-described problems, a shield case of the present invention includes a receiving portion of generally rectangular tuboid shape adapted to accommodate a body with contacts arrayed, the receiving portion having a top plate and side walls; a folded-back portion, provided at a front end of the receiving portion and folded back rearward, or provided at a rear end of the receiving portion and folded back forward; and a cover of generally downward U-shape, extending from the folded-back portion and along the top plate and the side walls of the receiving portion.

As the shield case has the cover extending along the top plate and the side walls of the receiving portion, the shield case has a double-layer structure: a first layer consisting of the top plate and the side walls of the receiving portion and a second layer consisting of the cover. Having such a double-layer structure, the shield case is unlikely to warp, particularly at the top plate of the receiving portion, even if a connection target inserted into the receiving portion applies a prying force in the circumferential direction on the receiving portion. In summary, the shield case of the invention has an advantageously high prying resistance. Moreover, the present shield case has a single piece structure, essentially consisting of the receiving portion, the folded-back portion provided at the front end of the receiving portion and folded back rearward or provided at the rear end of the receiving portion and folded back forward, and the cover extending from the folded-back portion. Owing to the single piece structure, the shield case is easy to fabricate by press molding or a similar process, obviating the need to combine two shield cases as in the second conventional art described above.

At least one pair of locking pieces may be provided at opposite end portions of the cover. In this aspect of the invention, the locking pieces can be provided without cutting out the bottom plate of the receiving portion, and holes will not be formed at such cut-out portions of the bottom plate. Consequently, the receiving portion will not allow entry of solder and flux if the receiving portion is placed on a circuit board and the locking pieces are connected to the circuit board by soldering. The elimination of holes is also advantageous in that the connection target inserted into the receiving portion will not get stuck with the holes.

If the folded-back portion is provided at the front end of the top plate of the receiving portion, the shield case may further include a back cover provided at the rear end of the receiving portion or at a rear end of the cover. The back cover may cover at least a portion of a rear face of the body. In this aspect of the invention, a connector having the shield case should be improved in terms of impedance matching and electromagnetic interference (EMI) characteristics because the back cover covers at least a portion of the body of the connector.

The receiving portion may further have a bottom plate. The top plate of the receiving portion may be provided with a projection projecting toward the bottom plate. The projection may abut a front face of the body. The back cover may abut the rear face of the body that is in abutment with the projection. That is, the body can be sandwiched between the projection and the back cover. Consequently, the body can be fixed easily in place inside the receiving portion, so that it is easy to incorporate the body into the receiving portion.

The projection may fit in a fitting recess formed in the front face of the body. In this aspect of the invention, fitting the projection in the fitting recess of the body enables the positioning of the body inside the receiving portion.

Alternatively, a rear end of the bottom plate of the receiving portion may abut the front face of the body. In this case, the back cover may abut the rear face of the body that is in abutment with the bottom plate. That is, the body may be sandwiched between the bottom plate of the receiving portion and the back cover. The body can be thus fixed easily in place inside the receiving portion, so that it is easy to incorporate the body into the receiving portion.

If the receiving portion is adapted to receive at least first and second plug connectors, the bottom plate of the receiving portion may be provided with a partition extending toward the top plate. The partition may section the inside of the receiving portion into first and second receiving holes for receiving first and second plug connectors.

A connector of the present invention includes the above shield case, the body accommodated in the receiving portion of the shield case, and the contacts arrayed along the width of the body.

DESCRIPTION OF EMBODIMENTS

Figure 1A:
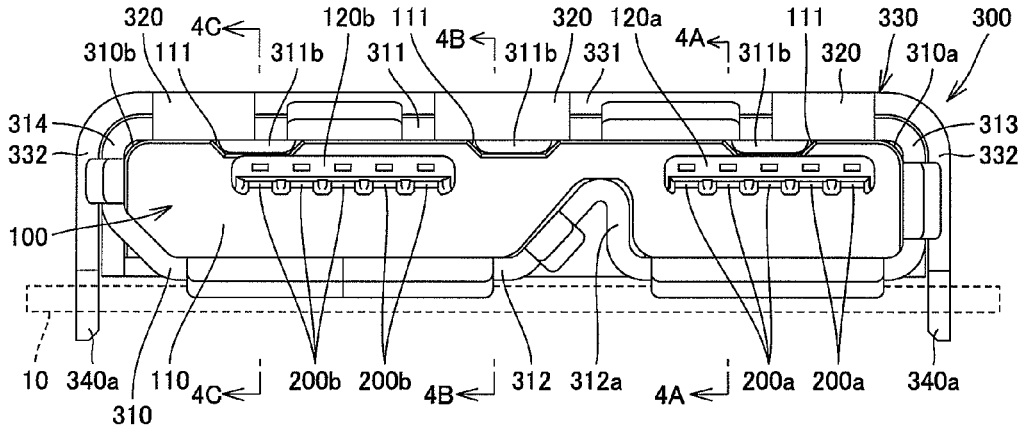
FIGS. 1A and 1B are schematic views of a receptacle connector according to an embodiment of the present invention mounted on a circuit board, FIG. 1A being a front view and FIG. 1B being a rear view.
Figure 1B:
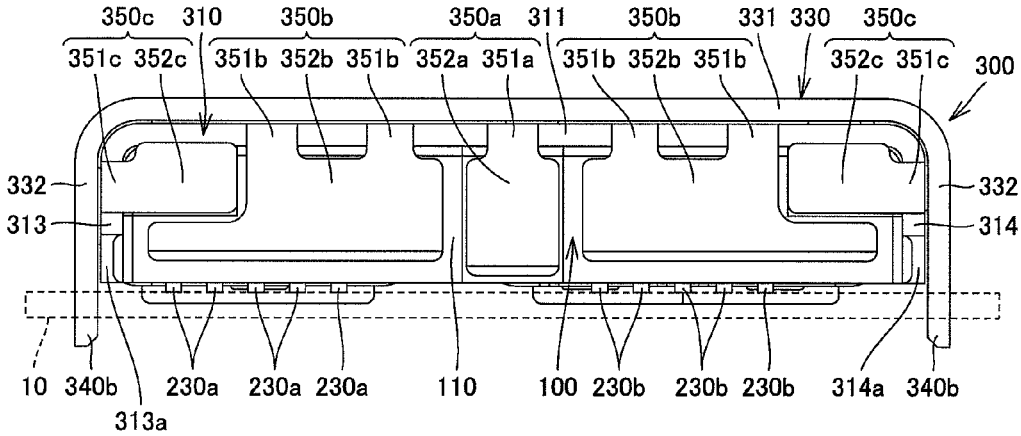

Hereinafter, a receptacle connector (hereinafter, referred to as a "receptacle") according to an embodiment of the present invention will be described with reference to FIGS. 1A to 5. The receptacle shown in FIGS. 1A and 1B is a connector to be mounted on a circuit board 10 of electronic equipment. The connector is used for connection with a USB 2.0 Micro plug connector (hereinafter, referred to as a "USB 2.0 plug") and a USB 3.0 Micro plug connector (hereinafter, referred to as a "USB 3.0 plug"), neither of which is shown. The receptacle includes a body 100, a plurality of first and second contacts 200*a* and 200*b*, and a shield case 300. The respective parts of the receptacle will be described in detail below.

Figure 2A:
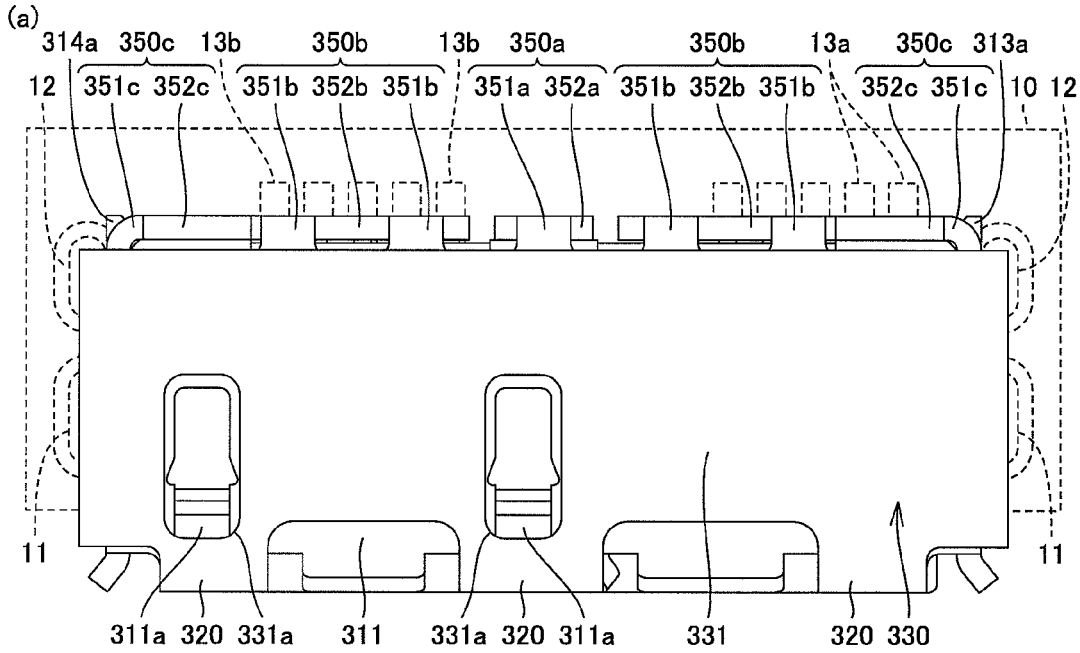
FIGS. 2A and 2B are schematic views of the connector mounted on the circuit board, FIG. 2A being a plan view and FIG. 2B being a bottom view.
Figure 2B:
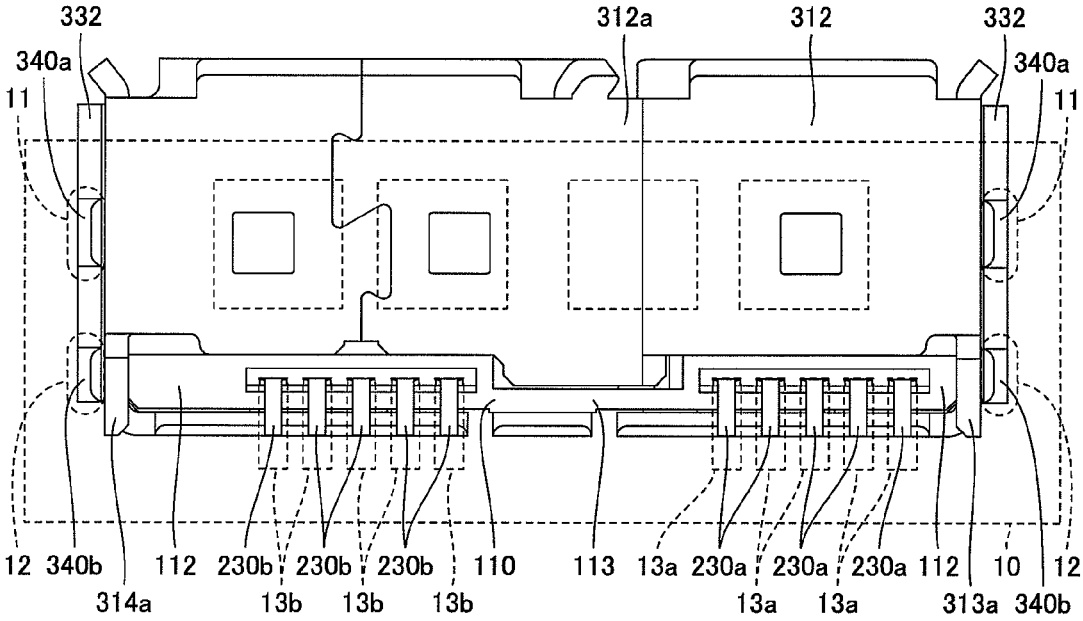
Figure 3A:
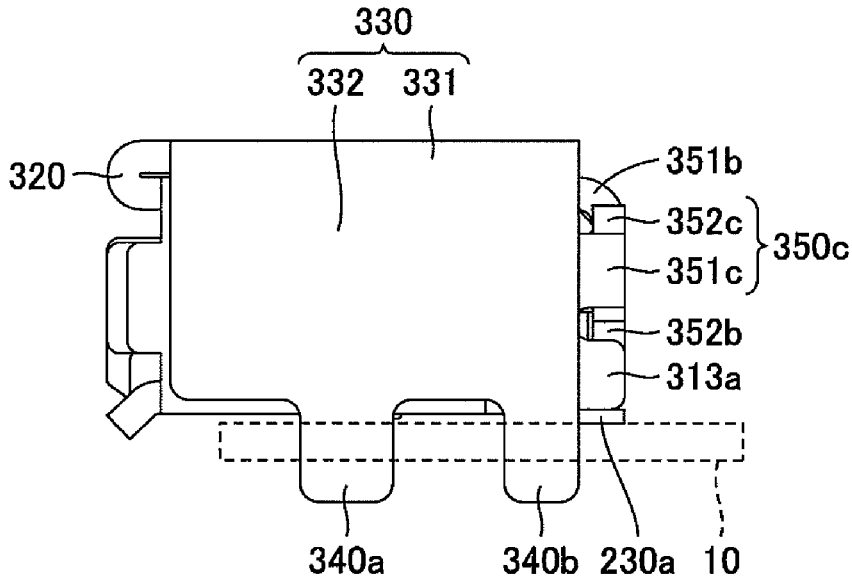
FIGS. 3A and 3B are schematic views of the connector mounted on the circuit board, FIG. 3A being a right side view and FIG. 3B being a left side view.
Figure 3B:
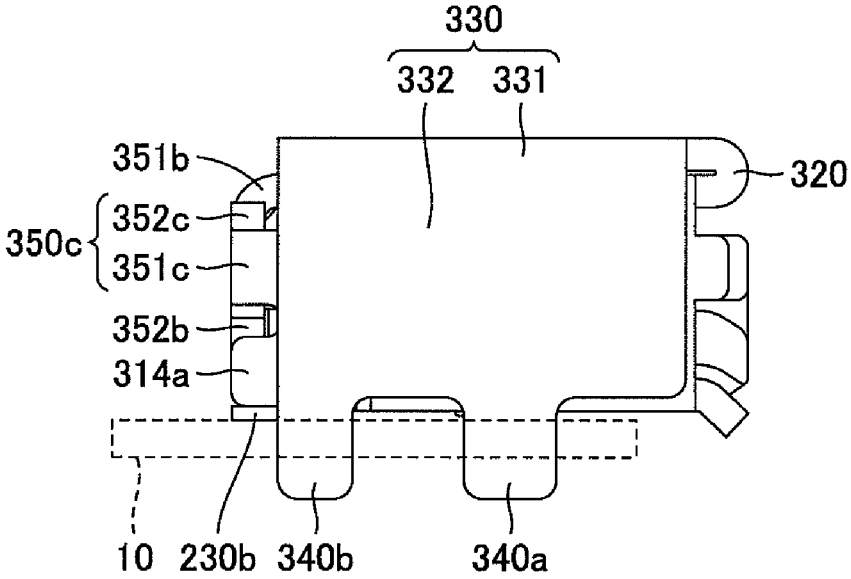

The shield case 300 is formed by press-molding a conductive metal plate. This shield case 300, as shown in FIGS. 1A to 4C, has a receiving portion 310, three folded-back portions 320, a cover 330, a pair of first locking pieces 340*a*, a pair of second locking pieces 340*b*, a first back cover 350*a*, a pair of second back covers 350*b*, and a pair of third back covers 350*c*. The receiving portion 310 is of a generally rectangular tuboid shape as shown in FIGS. 1A and 1B. The receiving portion 310 has a top plate 311, a bottom plate 312 opposed to the top plate 311, side walls 313 and 314 that connect ends of the top plate 311 and the bottom plate 312. The bottom plate 312, as shown in FIGS. 1A and 2B, is a substantially rectangular plate, the central portion of which is folded into a generally V shape inverted toward the top plate 311. The bottom plate 312 is inclined at its left portion shown in FIG. 1A. As shown in FIG. 2B, the central portion of the bottom plate 312 protrudes rearward with respect to outer end portions of the bottom plate 312. The aforementioned bent portion serves as a partition 312*a* that sections the inside space of the receiving portion 310 into first and second receiving holes 310*a* and 310*b*. The first and second receiving holes 310*a* and 310*b* have inner shapes conforming to outer shapes of the USB 2.0 plug and the USB 3.0 plug, respectively. That is, the first receiving hole 310*a* and the second receiving hole 310*b* are adapted to receive the USB 2.0 plug and the USB 3.0 plug, respectively. The top plate 311 is a generally rectangular plate as shown in FIGS. 1A and 2A. The top plate 311 is provided with a pair of cut-and-raised pieces 311*a* formed by cutting and raising portions of the top plate 311. As shown in FIGS. 1A, 1B, 4B and 4C, the rear portion of the top plate 311 is provided with three projections 311*b* projecting toward the bottom plate 312. The side wall 313 is a generally rectangular plate. The side wall 314 is a generally rectangular plate of a smaller height dimension than the side wall 313. Guide pieces 313*a* and 314*a* projecting rearward are provided at rear ends of lower ends of the side walls 313 and 314, respectively, as shown in FIGS. 1B, 2B and 3. The distance between the guide pieces 313*a* and 314*a* is slightly larger than a width dimension of a main body 110 of the body 100.

The folded-back portions 320 are plate bodies each having a lateral U shape in cross-sectional view, as shown in FIGS. 3 and 4. The three folded-back portions 320 extend from the widthwise center and opposite ends of the front end of the top plate 311, and they are folded backward, toward the rear side of the shield case 300. The cover 330 is provided continuously to upper ends of the folded-back portions 320.

Figure 4A:
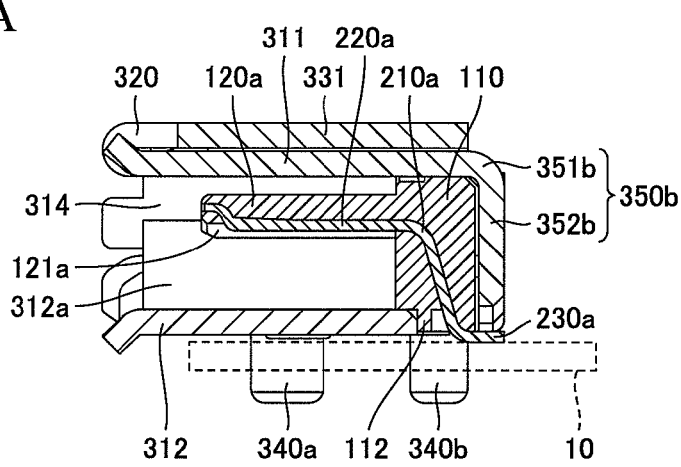
FIG. 4A is a cross-sectional view of the connector taken along the line 4A-4A in FIG. 1A.
Figure 4B:
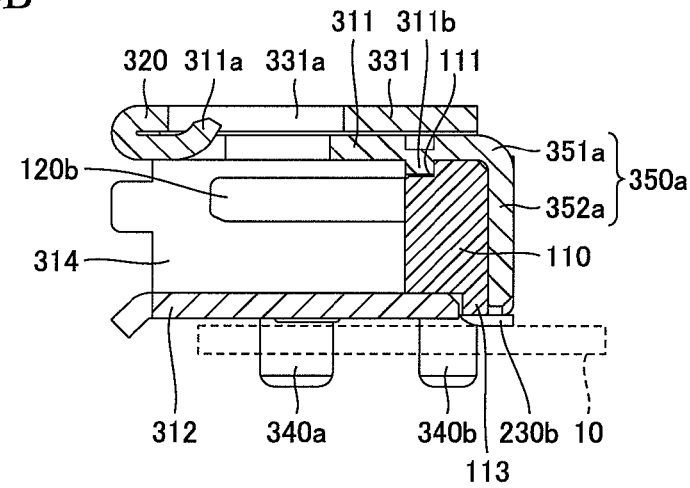
FIG. 4B is a cross-sectional view of the connector taken along the line 4B-4B in FIG. 1A.

The cover 330 is a generally downward U-shaped plate as shown in FIGS. 1A and 1B. The cover 330 has a central reinforcing plate 331 and a pair of side reinforcing plates 332 (end portions). The central reinforcing plate 331 is a generally rectangular plate extending along an upper surface of the top plate 311. The central reinforcing plate 331 has a larger width than the top plate 311, the front face of which is continued to the folded-back portions 320. As shown in FIGS. 2A and 4B, the central reinforcing plate 331 has generally rectangular long holes 331*a* at positions corresponding to the cut-and-raised pieces 311*a* of the top plate 311. Distal end portions of the cut-and-raised pieces 311*a* are received in the long holes 331*a*. The side reinforcing plates 332, as shown in FIGS. 1A and 1B, are generally rectangular plates provided continuously to opposite end portions of the central reinforcing plate 331 and extending along outer surfaces of the side walls 313, 314. The lower end of each of the side reinforcing plates 332 is provided with one of the first locking pieces 340*a* and one of the second locking pieces 340*b* extending downward. The first and second locking pieces 340*a* and 340*b* are to be inserted into locking holes 11 and 12, respectively, of the circuit board 10 and be connected to ground.

The first back cover 350*a* is provided continuously from a central rear end of the top plate 311 of the receiving portion 310, as shown in FIG. 1B. The second back covers 350*b* are provided on either side of the first back cover 350*a*, also continuously from the rear end of the top plates 311 of the receiving portion 310, as shown in FIG. 1B. The third back covers 350*c* are provided continuously from upper rear ends of the side walls 313 and 314 of the receiving portion 310, as shown in FIG. 1B. The first back cover 350*a* has a bent portion 351*a* and a cover main portion 352*a*, which is a generally rectangular plate provided continuously from the bent portion 351*a*. The bent portion 351*a* is bent substantially at a right angle to the top plate 311, so that the cover main portion 352*a* extends along and in abutment with a central portion of a rear face of the main body 110 of the body 100. Each of the second back covers 350*b* has a pair of bent portions 351*b* and a cover main portion 352*b*, which is a substantially L-shaped plate provided continuously from the bent portions 351*b*. Each of the third back covers 350*c* has a bent portion 351*c* and a cover main portion 352*c*, which is a generally rectangular plate provided continuously from the bent portion 351*c*. The bent portions 351*b* are bent substantially at a right angle with respect to the top plate 311, and the bent portions 351*c* are bent substantially at a right angle with respect to the side walls 313 and 314. The cover main portions 352*b* and 352*c* extend along and in abutment with opposite end portions of the rear face of the main body 110 of the body 100.

Figure 4C:
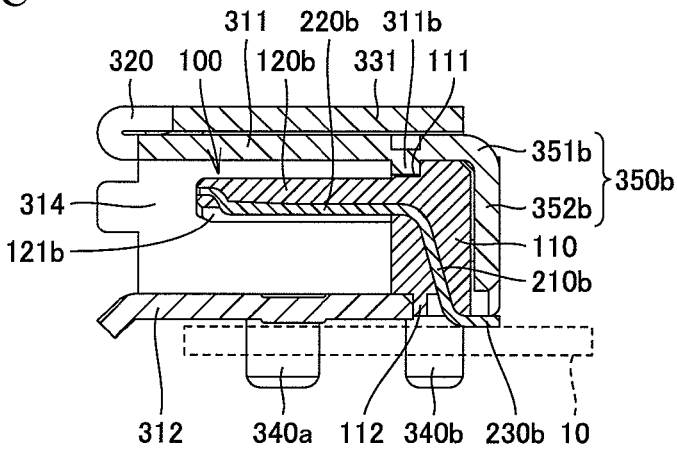
FIG. 4C is a cross-sectional view of the connector taken along the line 4C-4C in FIG. 1A.
Figure 5:
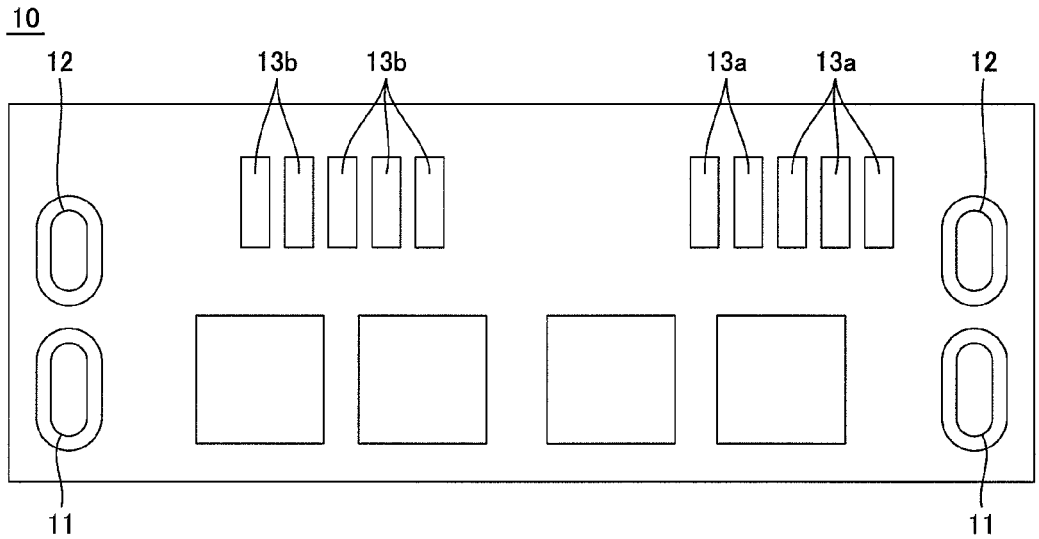
FIG. 5 is a schematic plan view of the circuit board for mounting the connector.

The body 100 is a molded article of insulating resin as shown in FIG. 1A. The body 100 has the aforementioned main body 110 and first and second projected portions 120*a*, 120*b*. The main body 110 is a plate-like body having a generally rectangular shape in cross-sectional view and is housed in the receiving portion 310 of the shield case 300. The upper end of the main body 110 is provided with three fitting recesses 111. The fitting recesses 111 fittingly receive the projections 311*b* of the shield case 300, such that bottom surfaces of the fitting recesses 111 abut the projections 311*b*. As shown in FIG. 2B, a rear-side lower end of the main body 110 is provided with a pair of outer elongated protrusions 112 and a central elongated protrusion 113 located between the outer elongated protrusions 112. Front surfaces of the outer elongated protrusions 112 abut against outer end portions of the rear end of the bottom plate 312 of the shield case 300, and a front surface of the central elongated protrusion 113 abuts against a central portion of the rear end of the bottom plate 312 of the shield case 300. Moreover, as shown in FIGS. 4A to 4C, the rear end surface of the main body 110 abuts the cover main portions 352*a*, 352*b*, 352*c* of the first, second and third back covers 350*a*, 350*b*, 350*c*. That is, the main body 110 is sandwiched between the projections 311*b* of the shield case 300 and the rear end of the bottom plate 312, and the cover main portions 352*a*, 352*b*, 352*c* of the first, second and third back covers 350*a*, 350*b*, 350*c*. Moreover, the respective outer faces of the outer elongated protrusions 112 of the main body 110 abut the guide pieces 313*a*, 314*b*, respectively, as shown in FIG. 2B.

The first projected portion 120*a* and the second projected portion 120*b* extend from front surfaces of the right and left portions, respectively as shown in FIG. 1A, of a the body 100. The first projected portion 120*a* is a flat plate-like projection and disposed inside the first receiving hole 310*a* of the receiving portion 310 of the shield case 300. A plurality of long grooves 121*a* are formed at spaced intervals along the width of a lower face of the first projected portion 120*a*. The second projected portion 120*b* is a flat plate-like projection and disposed inside the second receiving hole 310*b* of the receiving portion 310 of the shield case 300. A plurality of long grooves 121*b* are formed at spaced intervals along the width of a lower face of the second projected portion 120*b*. The first contacts 200*a* are buried by insert molding at spaced intervals (at the same pitch as the long grooves 121*a*) in the width direction inside the right portion of the main body 110 and the first projected portion 120*a*. The second contacts 200*b* are buried by insert molding at spaced intervals (at the same pitch as the long grooves 121*b*) in the width direction inside the left portion of the main body 110 and the second projected portion 120*b*.

The first contacts 200*a* are elongated conductive metal plates of generally L shape as shown in FIG. 4A. The first contacts 200*a* each have a generally L-shaped intermediate portion 210*a*, a distal end portion 220*a* continuing to the distal end of the intermediate portion 210*a*, and a tail portion 230*a* provided continuously to the rear end of the intermediate portion 210*a*. The intermediate portions 210*a* are buried in the main body 110 of the body 100, and rear ends thereof protrude downward from one of the outer protrusion 112 of the main body 110. The distal end portions 220*a* are buried in the first projected portion 120*a*, and lower ends thereof are exposed from the long grooves 121*a* of the first projected portion 120*a*. These exposed portions are to contact mating contacts of a USB 2.0 plug. The tail portions 230*a* extend rearward across a lower face of the outer protrusion 112 of the body 100. The tail portions 230*a* are to be connected by soldering to electrodes 13*a* of the circuit board 10.

The second contacts 200*b* are elongated conductive metal plates of generally L shape as shown in FIG. 4C. The second contacts 200*b* each have a generally L-shaped intermediate portion 210*b*, a distal end portion 220*b* continuing to the distal end of the intermediate portion 210*b*, and a tail portion 230*b* provided continuously to the rear end of the intermediate portion 210*b*. The intermediate portions 210*b* are buried in the main body 110 of the body 100, and rear ends thereof protrude downward from the other outer protrusion 112 of the main body 110. The distal end portions 220*b* are buried in the second projected portion 120*b*, and lower ends thereof are exposed from the long grooves 121*b* of the second projected portion 120*b*. These exposed portions are to contact mating contacts of a USB 3.0 plug. The tail portions 230*b* extend rearward across the lower face of the outer protrusion 112 of the body 100. The tail portions 230*b* are to be connected by soldering to electrodes 13*b* of the circuit board 10.

The receptacle according to the embodiment are configured as described above and assembled as described below. First, the body 100 in which the first and second contacts 200*a*, 200*b* are insert-molded is prepared. Also prepared is the shied case 300 before the bent portions 351*a*, 351*b*, 351*c* of the first, second and third back covers 350*a*, 350*b*, 350*c* are bent. The prepared body 100 is inserted through a rear-side opening in the receiving portion 310 of the shield case 300. At this time, the first and second projected portions 120*a*, 120*b* of the body 100 are inserted into the first and second receiving holes 310*a*, 310*b* of the receiving portion 310, and the widthwise ends of the main body 110 of the body 100 are brought into abutment with and guided by the pair of the guide pieces 313*a*, 314*a* of the shield case 300. When the body 100 is further inserted into the receiving portion 310 of the shield case 300, the projections 311*b* of the shield case 300 are fitted into the fitting recesses 111 of the main body 110 of the body 100, and the outer elongated protrusions 112 of the body 100 abut the outer end portions of the bottom plate 312 of the shield case 300, and the central elongated protrusion 113 of the body 100 abuts the central portion of the bottom plate 312 of the shield case 300. Thereafter, the bent portions 351*a*, 351*b*, 351*c* of the first, second and third back covers 350*a*, 350*b*, 350*c* are bent substantially at a right angle, so that the cover main portions 352*a*, 352*b*, 352*c* of the first, second and third back covers 350*a*, 350*b*, 350*c* abut the rear end face of the main body 110 of the body 100.

The receptacle is thus assembled and then mounted on the circuit board 10 in the following manner. First, the first and second locking pieces 340*a*, 340*b* of the shield case 300 are inserted into the locking holes 11, 12 of the circuit board 10, and the bottom plate 312 of the shield case 300 is placed on the circuit board 10. At this time, the tail portions 230*a*, 230*b* of the first and second contacts 200*a*, 200*b* are placed on the electrodes 13*a* and 13*b*, respectively, of the circuit board 10. Thereafter, the first and second locking pieces 340*a*, 340*b* are connected by soldering with the locking holes 11, 12 of the circuit board 10, and the tail portions 230*a*, 230*b* are connected by soldering with the electrodes 13*a* and 13*b*, respectively, of the circuit board 10.

The receptacle assembled as described above can be connected with a USB 2.0 plug and/or a USB 3.0 plug in the following manner. When a USB 2.0 plug is inserted into the first receiving hole 310*a* of the receiving portion 310 of the shield case 300, the contacts of the USB 2.0 plug come into contact with the distal end portions 220*a* of the first contacts

200*a* exposed from the long grooves 121*a* of the first projected portion 120*a* of the body 100. The USB 2.0 plug is thus connected to the present receptacle. When a USB 3.0 plug is inserted into the second receiving hole 310*b* of the receiving portion 310 of the shield case 300, the contacts of the USB 3.0 plug come into contact with the distal end portions 220*b* of the second contacts 200*b* exposed from the long grooves 121*b* of the second projected portion 120*b* of the body 100. The USB 3.0 plug is thus connected to the present receptacle.

In the receptacle as described above, the cover 330 of the shield case 300 is disposed along the top plate 311 and the side walls 313, 314 of the receiving portion 310. That is, the shield case 300 has a double-layer structure: a first layer consisting of the top plate 311 and the side walls 313, 314 of the receiving portion 310 and a second layer consisting of the central reinforcing plate 331 and the side reinforcing plates 332 of the cover 330. Having such a double-layer structure, the shield case 300 is unlikely to warp, particularly at the top plate 311 of the receiving portion 310, even if a prying force in the circumferential direction is applied on the receptacle by a USB 2.0 plug inserted into the first receiving hole 310*a* of the receiving portion 310 of the shield case 300, or by a USE 3.0 plug inserted into the second receiving hole 310*b* of the receiving portion 310. In summary, the shield case 300 of the present receptacle has an advantageously high prying resistance. Moreover, the shield case 300 is easy to fabricate by press molding owing to a single piece structure, essentially consisting of the receiving portion 310, the folded-back portions 320 provided along the front end of the top plate 311 of the receiving portion 310 and folded back rearward, the cover 330 extending from the folded-back portions 320, the pair of first and second locking pieces 340*a*, 340*b* extended from the lower ends of the side reinforcing plates 332 of the cover 330, the first back cover 350*a* and the pair of second back covers 350*b*, which three back covers extend continuously from the rear end of the top plate 311 of the receiving portion 310, and the pair of third back covers 350*c* extended continuously from the side walls 313, 314 of the receiving portion 310.

Moreover, the pair of first and second locking pieces 340*a*, 340*b* also extends continuously from the lower ends of the side reinforcing plates 332 of the cover 330. This makes it unnecessary to form locking pieces by cutting out the bottom plate 312 of the receiving portion 310, so that holes will not be formed at such cut-out portions of the bottom plate 312. Consequently, the receiving portion 310 will not allow entry of solder and flux when the receptacle is placed on the circuit board 10 and the first and second locking pieces 340*a*, 340*b* are connected by soldering with the locking holes 11, 12 of the circuit board 10. The elimination of holes is also advantageous in that a USB 2.0 plug and a USB 3.0 plug inserted into the first and second receiving holes 310*a*, 310*b* of the receiving portion 310 will not get stuck with the holes.

Moreover, the body 100 can be easily fixed inside the receiving portion 310 of the shield case 300. More particularly, when the body 100 is inserted into the receiving portion 310 of the shield case 300, simply by fitting the projections 311*b* of the shield case 300 in the recesses 111 of the main body 110, and bringing the outer elongated protrusions 112 and the central elongated protrusion 113 of the main body 110 into abutment with the bottom plate 312 of the shield case 300, and then bending the bent portions 351*a*, 351*b*, 351*c* of the first, second and third back covers 350*a*, 350*b*, 350*c* in such a manner that the cover main portions 352*a*, 352*b*, 352*c* abut the rear end surface of the main body 110, the main body 110 will be sandwiched between the projections 311*b* and the bottom plate 312 of the shield case 300, and the cover main portions 352*a*, 352*b*, 352*c*. Consequently, the body 100 can be easily incorporated into the receiving portion 310. Further, when the body 100 is inserted into the receiving portion 310 of the shield case 300, the pair of outer elongated protrusions 112 of the main body 110 of the body 100 is guided by the pair of guide pieces 313*a*, 314*a* of the shield case 300. Therefore, it is easy to fit the projections 311*b* of the shield case 300 into the recesses 111 of the main body 110.

Further advantageously, the cover main portions 352*a*, 352*b*, 352*c* of the first, second, third back covers 350*a*, 350*b*, 350*c* cover the rear end face of the main body 110. The present receptacle is therefore improved in terms of impedance matching and EMI characteristics.

The above-described receptacle connector is not limited to the above embodiment but can be modified in design within the scope described in the claims. Hereinafter, modification examples will be described in detail below.

The shield case 300 of the above embodiment is adapted to receive a USB 2.0 Micro plug connector and a USB 3.0 Micro plug connector into the first and second receiving holes 310*a*, 310*b* of the receiving portion 310 thereof. However, the present invention is not limited thereto, but the first and second receiving holes 310*a*, 310*b* may receive a plug connector of a type other than the Micro USB 2.0 plug connector and the Micro USB 3.0 plug connector. Moreover, the receiving portion 310 of the present invention is not limited to the above embodiment wherein the inside of the receiving portion 310 is sectioned into the first and second receiving holes 310*a*, 310*b* with the partition 312*a* of the bottom plate 312. Instead, the receiving portion 310 may have a single receiving hole without a partition for receiving a plug connector. The receiving holes of the receiving portion may receive at least one plug or receptacle connector. That is, the present invention can be applied not only to a receptacle connector but also to a plug connector. If the partition 312*a* is provided, it can be formed by folding the bottom plate 312 of the receiving portion 310 as in the above embodiment, or by cutting and raising a portion of the bottom plate 312 of the receiving portion 310, or by providing a separate partition on the bottom plate 312.

Moreover, the folded-back portions 320 of the above embodiment are provided along the front end of the top plate 311 of the receiving portion 310 and folded back toward the rear side. Alternatively, a single folded back portion may be provided at or along the front end of the top plate 311. Further alternatively, at least one folded-back portion may be provided at or along the rear end of the top plate 311 and folded back toward the front side. Moreover, instead of being provided on the top plate 311 of the receiving portion 310, the folded-back portions 320 may be provided along front or rear ends of the side walls 313, 314. In this case, the folded-back portions 320 may of a generally U shape in plan view to connect the front or rear ends of the side walls 313, 314 and the front or rear ends of the side reinforcing plates 332. If the folded-back portions 320 are provided along the rear ends of the top plate 311 or the side walls 313, 314, the first, second and third back covers 350*a*, 350*b*, 350*c* may be omitted.

The present invention is not limited to the above embodiment where the projections 311*b* of the top plate 311 of the receiving portion 310 are fitted in the fitting recesses 111 of the main body 110 of the body 100. It is possible to provide a single projection 311*b* or even possible to omit the projections 311*b*. Moreover, the projections 311*b* may be adapted to abut the front face of the main body 110. Similarly, the bottom plate 312 of the receiving portion 310 of the embodiment is configured such that its rear end abuts the outer elongated protrusions 112 and the central elongated protrusion 113 of the main body 110. Alternatively, the bottom plate 312 of the receiving portion 310 may abut only the outer elongated protrusions 112, or only the central elongated protrusion 113, or none of the elongated protrusions 112 and 113. The bottom plate 312 may have the central portion protruding rearward as in the above embodiment, or it may have a central portion flush the outer end portions.

The shield case 300 may or may not have the first, second and third back covers 350*a*, 350*b*, 350*c* as in the above embodiment. For example, the shield case 300 may have at least one of the first, second and third back covers 350*a*, 350*b*, 350*c*, or may have none of the back covers. Moreover, the first, second and third back covers 350*a*, 350*b*, 350*c* may not be provided along rear end of the receiving portion 310 as in the above embodiment, but they may be provided along the rear end of the cover 330.

Moreover, the present invention is not limited to the above embodiment wherein the first and second locking pieces 340*a*, 340*b* extend from the lower ends of the side reinforcing plates 332 of the cover 330. For example, the first and second locking pieces 340*a*, 340*b* may be formed by cutting out portions of the side reinforcing plates 332. Alternatively, the first and second locking pieces 340*a*, 340*b* may be provided on the bottom plate 312 of the receiving portion 310. At least one of the paired first locking pieces 340*a* or the paired second locking pieces 340*b* will suffice. The first and second locking pieces 340*a*, 340*b* may be omitted if the present connector is applied to a plug connector.

The shield case 300 of the above embodiment is fabricated by press-molding a metal plate. Alternatively, the shield case 300 may be fabricated by depositing metal onto an inner surface of a case made of insulating resin.

The shape of the body 100 can be changed in accordance with shapes of the connection targets to be inserted into the receiving holes of the receiving portion as needed. The shapes and array of the contacts 200*a*, 200*b* can be changed in accordance with the shapes of the connection targets as needed.

The materials, shapes, numbers, dimensions, etc. constituting the receptacle connector of the above embodiment are described as examples only. The materials, etc. may be modified as long as they can provide similar functions.

REFERENCE SIGNS LIST

10 circuit board
11 locking hole
12 locking hole
13*a* electrode
13*b* electrode
100 body
110 main body
111 fitting recess
112 outer elongated protrusion
113 central elongated protrusion
120*a* first projected portion
120*b* second projected portion
200*a* first contact
200*b* second contact
300 shield case
310 receiving portion
311 top plate
311*a* cut-and-raised piece
311*b* projection
312 bottom plate
313 side wall
314 side wall
320 folded-back portion
330 cover
340*a* first locking piece
340*b* second locking piece
350*a* first back cover
350*b* second back cover
350*c* third back cover

The invention claimed is:

1. A shield case having conductivity comprising:

a receiving portion of generally rectangular tuboid shape adapted to accommodate a body with contacts arrayed, the receiving portion having a top plate and side walls, the side walls extending from widthwise ends of the top plate;

a folded-back portion of a lateral U shape, provided at a front end of the receiving portion and folded back outward and rearward, or provided at a rear end of the receiving portion and folded back outward and forward; and a cover of generally downward U-shape, extending from the folded-back portion, the cover including:

a central reinforcing portion, extending along an outer face of the top plate of the receiving portion and having a larger width than the top plate, and a pair of side reinforcing portions, extending from widthwise ends of the central reinforcing portion and along outer faces of the side walls of the receiving portion.

2. The shield case according to claim 1, wherein at least one pair of locking pieces is provided at opposite end portions of the cover.

3. The shield case according to claim 1 with the folded-back portion provided at the front end of the top plate of the receiving portion, further comprising:

a back cover, provided at the rear end of the receiving portion and adapted to cover at least a portion of a rear end face of the body.

4. The shield case according to claim 1 with the folded-back portion provided at the front end of the top plate of the receiving portion, further comprising:

a back cover, provided at a rear end of the cover and adapted to cover at least a portion of a rear face of the body.

5. The shield case according to claim 1, wherein the receiving portion further has a bottom plate, the top plate of the receiving portion is provided with a projection projecting toward the bottom plate, the projection is abuttable on a front face of the body, and a back cover is abuttable on the rear face of the body that is in abutment with the projection.

6. The shield case according to claim 4, wherein the receiving portion further has a bottom plate, the top plate of the receiving portion is provided with a projection projecting toward the bottom plate, the projection is abuttable on a front face of the body, and the back cover is abuttable on the rear face of the body that is in abutment with the projection.

7. The shield case according to claim 3, wherein the receiving portion further has a bottom plate, a rear end of which is abuttable on a front face of the body, and the back cover is abuttable on the rear face of the body that is in abutment with the bottom plate.

8. The shield case according to claim 4, wherein the receiving portion further has a bottom plate, a rear end of which is abuttable on a front face of the body, and the back cover is abuttable on the rear face of the body that is in abutment with the bottom plate.

9. The shield case according to claim 1, wherein the receiving portion is adapted to receive at least first and second plug connectors, the receiving portion further has a bottom plate, the bottom plate being provided with a partition extending toward the top plate, and the partition sections an inside of the receiving portion into first and second receiving holes for receiving first and second plug connectors.

10. A connector comprising:

the shield case according to claim 1;

the body accommodated in the receiving portion of the shield case; and the contacts arrayed along the width of the body.

11. A shield case comprising:

a receiving portion of generally rectangular tuboid shape adapted to accommodate a body with contacts arrayed, the receiving portion having a top plate, side walls, and a bottom plate;

a folded-back portion, provided at a front end of the receiving portion and folded back rearward, or provided at a rear end of the receiving portion and folded back forward; and a cover of generally downward U-shape, extending from the folded-back portion and along the top plate and the side walls of the receiving portion; and a back cover, provided at the rear end of the receiving portion and adapted to cover at least a portion of a rear end face of the body, wherein the top plate of the receiving portion is provided with a projection projecting toward the bottom plate, the projection is abuttable on a front face of the body, the back cover is abuttable on the rear face of the body that is in abutment with the projection; and the projection is adapted to fit in a fitting recess formed in the front face of the body.

12. A shield case comprising:

a receiving portion of generally rectangular tuboid shape adapted to accommodate a body with contacts arrayed, the receiving portion having a top plate, side walls, and a bottom plate;

a folded-back portion, provided at a front end of the receiving portion and folded back rearward, or provided at a rear end of the receiving portion and folded back forward; and a cover of generally downward U-shape, extending from the folded-back portion and along the top plate and the side walls of the receiving portion; and a back cover, provided at the rear end of the cover and adapted to cover at least a portion of a rear end face of the body, wherein the top plate of the receiving portion is provided with a projection projecting toward the bottom plate, the projection is abuttable on a front face of the body, the back cover is abuttable on the rear face of the body that is in abutment with the projection; and the projection is adapted to fit in a fitting recess formed in the front face of the body.

* * * * *